United States Patent [19]

Jacobs

[11] 4,287,635

[45] Sep. 8, 1981

[54] WET AND DRY VACUUM CLEANER

[76] Inventor: Paul G. Jacobs, 9958 Amestoy Ave., Northridge, Calif. 91325

[21] Appl. No.: 36,295

[22] Filed: May 7, 1979

[51] Int. Cl.[3] ..... A47L 7/00

[52] U.S. Cl. ..... 15/321; 15/328; 15/353

[58] Field of Search ..... 15/320, 321, 352, 353, 15/347, 328

[56] References Cited

U.S. PATENT DOCUMENTS

| | | | |
|---|---|---|---|
| 3,006,020 | 10/1961 | Fillery | 15/353 X |
| 3,180,071 | 4/1965 | Nolte | 55/213 |
| 3,206,787 | 9/1965 | Daniels et al. | 15/353 X |
| 3,821,830 | 7/1974 | Sundheim | 15/321 |
| 3,896,520 | 7/1975 | Williams | 15/353 X |
| 4,019,218 | 4/1977 | Cyphert | 15/321 |
| 4,083,705 | 4/1978 | Parise et al. | 15/353 X |
| 4,138,761 | 2/1979 | Nauta | 15/321 X |

FOREIGN PATENT DOCUMENTS

| | | | |
|---|---|---|---|
| 7706194 | 12/1978 | Netherlands | 15/321 |

*Primary Examiner*—Chris K. Moore

*Attorney, Agent, or Firm*—Fulwider, Patton, Rieber, Lee & Utecht

[57] ABSTRACT

A vacuum cleaner for vacuum cleaning wet or dry surfaces is provided which includes an easily removable recovery tank which forms a portion of a vacuum chamber, and into which refuse or dirt picked up by the vacuum cleaner enters through a port arranged above the tank and centered thereover. Various different types of dirt-collecting devices can be used within the recovery tank without requiring any physical connection to or through the recovery tank itself.

6 Claims, 4 Drawing Figures

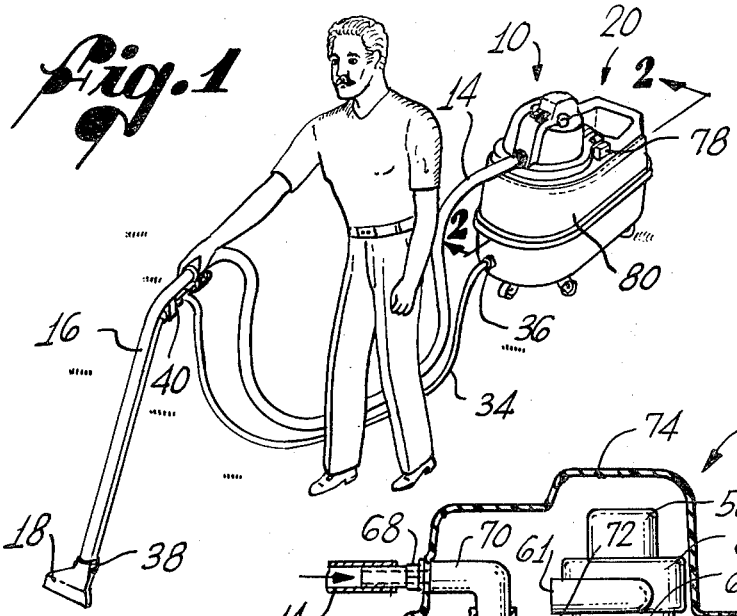
Fig. 1
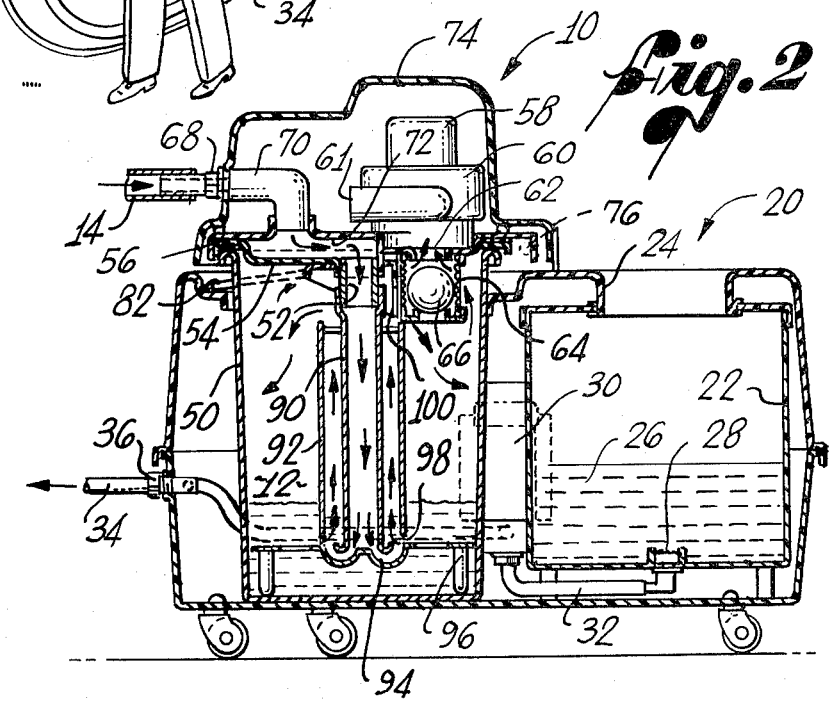
Fig. 2
Fig. 3
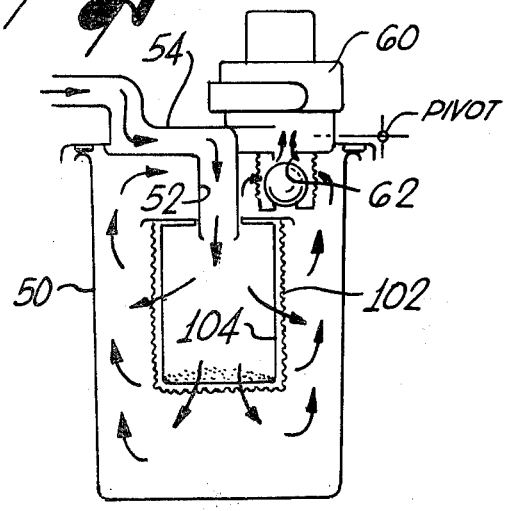
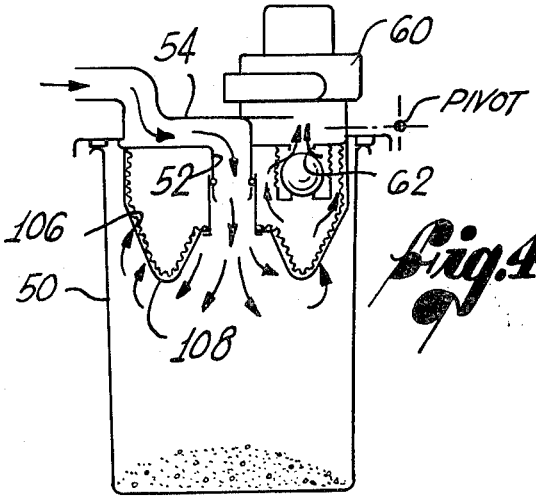
Fig. 4

WET AND DRY VACUUM CLEANER

BACKGROUND OF THE INVENTION

This invention relates generally to vacuum cleaners for home or commercial use, and more particularly, to a portable vacuum cleaner which is capable of vacuum cleaning both wet and dry surfaces.

As is well known in the art, it is highly desirable for a vacuum cleaner to be capable of picking up liquid from a surface being cleaned, as well as ordinary dust and soil. An arrangement for accomplishing this is required, for example, when using a so-called "steam" cleaning device which sprays a liquid cleaning solution onto a surface such as a carpet and removes the liquid cleaning solution, together with dissolved soil, and deposits the soiled mixture in a holding or recovery tank.

One way in which this has been accomplished is by providing a machine which includes both a cleaning solution reservoir and a separate recovery tank. A pump is associated with the cleaning solution reservoir for dispensing the solution at high pressure, and a vacuum fan is associated with the recovery tank for depositing soiled cleaning solution in the recovery tank.

Since it is also desirable to make such a cleaning device relatively small so that it can be easily handled, the reservoir and recovery tanks are rather small. Accordingly, in operation of such a device, the recovery tank must frequently be emptied. In wet and dry vacuum cleaning devices known heretofore, it was necessary either to tip the entire cleaning device or to disconnect hose attachments from a removable recovery tank in order to remove the tank to be emptied. In the latter case, the attachments had to be reconnected before the cleaning operation could resume.

It is sometimes desirable to operate a vacuum cleaning device in a conventional dry mode employing either a foraminate paper bag or cloth filter to separate particles of dust and soil from air drawn into the vacuum chamber. In vacuum cleaning devices known heretofore, there has been no provision for easily and conveniently converting a wet vacuum cleaning device to a conventional dry mode of operation.

Accordingly, there has existed a need for a relatively small and effective wet and dry vacuum cleaning device which is convenient to operate and can be easily converted for conventional dry vacuum cleaning service. As will become apparent from the following, the present invention satisfies that need.

SUMMARY OF THE INVENTION

The present invention resides in a new and improved vacuum cleaner for vacuum cleaning wet and dry surfaces which can be easily converted for use as a conventional dry vacuum cleaner, and which includes a recovery tank arranged to be conveniently removed from the vacuum cleaner to be emptied without having to disconnect any vacuum conduits, or the like. Moreover, the vacuum cleaner of the present invention is relatively inexpensive to manufacture, is trouble-free and reliable in use, and can easily be constructed in combination with a cleaning solution reservoir and pressure pump to form a "steam" cleaning apparatus.

More specifically, the vacuum cleaner of the present invention includes a support structure in which is carried an open top recovery tank for retaining soiled solid or liquid material. A cover, hinged to the support structure, overlies the open top of the recovery tank forming a vacuum chamber in the tank, and a vacuum fan is mounted on the cover for drawing a vacuum within the vacuum chamber. The cover also includes a centrally located opening into the vacuum chamber which opening is in communication with a flexible vacuum hose attached to a vacuum cleaning tool for cleaning a wet or dry surface.

When arranged for use in vacuum cleaning a wet surface, a downwardly extending tube is secured to the central opening in the cover and extends substantially to the bottom of the recovery tank. A deflector is supported on the bottom of the tank adjacent the bottom end of the downwardly extending tube for deflecting the combination of liquid, soil and air entering the tank upwardly through a second concentric tube, surrounding the downwardly extending tube. An aperture is provided between the tubes and the deflector to permit any liquid in the tank to enter the bottom of the tubes. By this arrangement, the soil is retained in the liquid in the recovery tank, and the air is drawn through the fan and exhausted into the atmosphere.

Alternatively, the vacuum cleaner of this invention can be arranged for vacuum cleaning dry surfaces by securing a foraminate bag to the central opening in the cover for filtering air passing from the central opening to an intake of the vacuum fan. Another arrangement for dry vacuum cleaning can be constructed by securing a wire frame to the cover for supporting a cloth filter substantially across the top of the recovery tank, with the cloth filter interposed between the central opening and the vacuum fan inlet. With the inlet from the vacuum hose arranged centrally above the recovery tank, the vacuum cleaner of the present invention can be easily and quickly converted for wet or dry vacuum cleaning. Moreover, the central opening ensures that when the vacuum cleaner is arranged for vacuum cleaning a wet surface, the tube extending downwardly from the cover will always be properly aligned with the deflector in the recovery tank.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of a vacuum cleaner embodying the present invention, and illustrated as normally used for wet or dry vacuum cleaning;

FIG. 2 is an enlarged, elevational view, partly in section, of the vacuum cleaner of FIG. 1, and taken generally along line 2—2 of FIG. 1;

FIG. 3 is a diagrammatic view of a vacuum cleaner embodying the present invention, and illustrated as arranged for vacuum cleaning dry surfaces; and FIG. 4 is a diagrammatic view of an alternative embodiment of the present invention, and illustrated as arranged for vacuum cleaning dry surfaces.

DETAILED DESCRIPTION

As shown in the exemplary drawings, the present invention is embodied in a portable vacuum cleaner, intended for home or commercial use and indicated generally by reference numeral 10 in FIG. 1. Electrical power is supplied to the vacuum cleaner 10 through a conventional power cord (not shown) and the vacuum cleaner 10 is arranged to draw a vacuum in a vacuum chamber 12 (FIG. 2), which in turn draws air inwardly through a vacuum hose 14. One end of the vacuum hose 14 is secured to the vacuum cleaner 10, and the other end of the vacuum hose 14 is connected to a vacuum cleaning tool 16, including a cleaning head 18, which can be used in a conventional manner for vacuum cleaning a wet or dry surface, such as the carpeted floor illustrated in FIG. 1.

In the exemplary embodiment illustrated in FIGS. 1 and 2, the vacuum cleaner 10 is shown as assembled in combination with a liquid cleaning solution spray applicator, indicated generally by reference numeral 20 in FIG. 1. As can best be seen in FIG. 2, the cleaning solution spray applicator includes a cleaning solution reservoir 22 having an open top 24 for receiving a quantity of liquid cleaning solution 26. A drain 28 is provided in the bottom of the reservoir 22, a liquid pump 30 is connected to the drain by a fluid line 32, and the pump is arranged to provide cleaning solution under pressure to a cleaning solution conduit 34.

One end of the conduit 34 is releasably secured to the vacuum cleaner 10 by a coupling 36, and the other end is connected to the tool 16 for spraying cleaning solution onto the surface being cleaned. For this purpose, a spray nozzle 38 is provided on the tool 16 adjacent the cleaning head 18, and to permit selective application of the cleaning solution, a manual control valve 40 is interposed in the fluid path of the cleaning solution and is conveniently located on the tool 16. With this arrangement, the tool 16 can be used in a well-known manner to simultaneously spray the cleaning solution 26 into, for example, a carpet, and to remove by vacuum the liquid solution, together with dissolved and solid particles of soil.

In accordance with the present invention, the wet and dry vacuum cleaner 10 includes an easily removable recovery tank 50 (FIG. 2) which forms a portion of the vacuum chamber 12, and into which the cleaning solution 26 and accompanying soil picked up by the vacuum cleaner enters through a port 52 arranged above the tank and centered thereover. With this arrangement, as will be described in greater detail below, various different types of dirt-collecting devices can be used without requiring any physical connection to or through the recovery tank 50, thereby permitting the recovery tank, which can simply be a stainless steel pail, to be easily and conveniently removed from the vacuum cleaner and emptied of soiled material. Moreover, the vacuum cleaner 10 of the present invention is relatively inexpensive to manufacture, is trouble-free and reliable in use, and can easily be adapted for use in connection with the cleaning solution applicator 20.

In order to draw a vacuum in the vacuum chamber 12, the open top of the recovery tank 50 is closed by a cover 54 which includes a soft peripheral seal 56 for bearing against the upper edge of the tank 50. A motor 58 and vacuum fan 60 are mounted on the cover 54, and the air inlet of the fan communicates with the vacuum chamber 12 through an aperture 62 in the cover, a screen 64, and ball valve 66 arranged adjacent the aperture 62 for reasons that will be described in detail below.

When a vacuum is drawn in the vacuum chamber 12, air is drawn into the recovery tank 50 through the vacuum hose 14, a coupling 68 connecting the hose to an elbow 70 which in turn is connected to a passage 72 through the cover 54, which communicates with the vacuum chamber inlet port 52. The cover 54 is secured to a housing 74 which surrounds the motor 58 and fan 60 and on which is mounted the coupling 68. Air is exhausted under the housing 74 from an outlet 61 of the fan 60, and vented to atmosphere by passing between the cover 54 and the housing 74.

To facilitate easy removal of the recovery tank 50 for cleaning, the cover 54 and housing 74 are pivotally mounted on a pair of pins 76 received in a pair of bosses 78 upstanding from a support structure 80 of the vacuum cleaner 10. With this arrangement, the cover 54 and housing 74 can be rotated up and away from the recovery tank 50, and the tank can be lifted from the vacuum cleaner, as by a handle 82. Moreover, when the tank 50 is replaced in the vacuum cleaner and the cover 54 and housing 74 are returned to their operating position, as shown in FIG. 2, the weight of the motor 58 and fan 60, as well as the housing 74, contributes to providing the desired air-tight seal between the cover 54 and the tank 50.

When the vacuum cleaner 10 is arranged for vacuum cleaning a wet surface, as for example when it is being used in combination with the cleaning solution applicator 20, a downwardly extending tube 90 is secured about the central port 52 in the cover 54, and the tube 90 is sized to extend substantially to the bottom of the tank 50. A larger concentric tube 92 is secured to the tube 90 and opens into the vacuum chamber 12 about its upper end.

For the purpose of deflecting soiled water drawn into the vacuum chamber 12 through the tube 90, a deflector 94 having upwardly facing curved surfaces is arranged below the tubes 90 and 92 and supported on an open stand 96 which rests in the bottom of the recovery tank 50.

As mentioned above, the recovery tank 50 is preferably an ordinary stainless steel pail having a generally cylindrical shape, and the stand 96 is sized to fit in the bottom of the tank 50 so that, in any rotational position, the deflector 94 will remain in the center of the tank. In this way, since the tubes 90 and 92 depend from the port 52 which is centered in the cover 54, no adjustments need to be made each time the tank is removed and replaced in the support structure 80 to assure that the tubes will be properly aligned over the deflector, thereby further enhancing the convenient operation of the vacuum cleaner 10.

As can best be seen in FIG. 2, the lower end of the tubes 90 and 92 terminate slightly above the deflector 94, leaving an opening 98 through which any liquid in the tank 50 can flow into the lower end of the tubes. This arrangement enhances the ability of the vacuum cleaner 10 to filter particles of soil from the air, liquid and soil mixture drawn in through the tube 90 by causing that mixture to pass through the liquid in the tank, causing some of that liquid to be carried upwardly through the larger, concentric tube 92, thereby providing greater opportunity for the liquid to filter particles of soil from the mixture picked up by the vacuum cleaner. To prevent any particles of soil or liquid from being drawn into the intake of the fan 60, a baffle 100 can be arranged adjacent the top of the tube 92 to deflect material away from the aperture 62.

As the vacuum cleaner 10 continues to pick up soiled liquid, the tank 50 will gradually fill, and the liquid will eventually float the ball valve 66 within the screened cage 64 and close the aperture 62. When this occurs, the motor 58 can be turned off, the housing 74 can simply be pivoted up and away from the tank 50 about the pins 76, and the tank 50 can be easily removed and emptied. It will be appreciated that all of this can be accomplished easily and conveniently without having to disconnect and reconnect any hoses, pressure lines, or the like. Moreover, since the port 52 is centered in the cover 54, the tubes 90 and 92 will automatically be replaced in the tank 50 with the proper alignment with respect to the deflector 94 when the housing 74 is returned to the position shown in FIG. 2, without requiring any special adjustment.

As can best be seen in diagrammatic FIGS. 3 and 4, the vacuum cleaner 10 can be arranged, if desired, for conventional dry vacuum cleaning. In the arrangement illustrated in FIG. 3, a wire screen 102 is secured to the port 52 and depends therefrom within the tank 50, and a conventional foraminate bag 104, which can simply be of paper construction, is secured about the end of the port 52 and disposed within the screen 102. As with a conventional foraminate bag, the foramina of the bag 104 are sufficiently large to permit air to easily pass from the port 52 to the aperture 62 in the cover 54, but to retain particles of dirt removed from the surface being cleaned by the vacuum cleaner 10 during a dry vacuum cleaning operation.

In the dry vacuum cleaning arrangement illustrated diagrammatically in FIG. 4, a wire frame or screen 106 is secured to the port 52 and substantially covers the top of the tank 50, and a cloth filter 108 is disposed over the wire frame and between the port 52 and the aperture 62 in the cover 54. With this arrangement, particles of dirt picked up by the vacuum cleaner 10 during dry vacuum cleaning will be removed from the air passing from the port 52 to the aperture 62 by the cloth filter 108 and retained in the tank 50.

From the foregoing, it will be appreciated that the wet and dry vacuum cleaner 10 of the present invention provides an apparatus by which the recovery tank 50 can be easily and conveniently removed and replaced in the vacuum cleaner without requiring the connection or disconnection of any conduits passing to or through the tank 50. Moreover, the vacuum cleaner 10 can be fabricated conveniently and economically, and can be adapted for use with various different types of dirt-collecting devices for wet or dry vacuum cleaning.

While several particular forms of the invention have been illustrated and described, it will also be apparent that various modifications can be made without departing from the spirit and scope of the invention.

I claim:

1. A vacuum cleaner for vacuum cleaning wet or dry surfaces, said vacuum cleaner comprising:

a support structure;

an open top recovery tank for receiving soiled material removed from said surface, said tank being releasably mounted in said structure;

a cover on said tank hinged to said support structure and having a seal for cooperating with the periphery of said open top and forming a vacuum chamber in said tank;

a fan mounted on said cover, said fan having an air inlet and an air outlet;

a first passage through said cover placing said inlet of said fan in communication with said vacuum chamber; and a second passage through said cover, said second passage at one end opening into said vacuum chamber above and geometrically centered over said vacuum chamber and having a means at its other end for connecting to a vacuum conduit through which material removed from said surface moves toward said recovery tank.

2. A vacuum cleaner as set forth in claim 1 further including a downwardly extending tube secured to said one end of said second passage and extending substantially to the bottom of said recovery tank, a deflector adjacent the bottom of said tube for deflecting soiled material removed from said surface upwardly within a second concentric tube, surrounding said downwardly extending tube, an opening adjacent the bottom of said tubes to permit liquid in said tank to enter the bottom of said tubes, whereby, when a combination of soil, liquid an air is drawn into said tank, said soil and liquid will be thoroughly mixed together in said concentric tubes and retained in said recovery tank.

3. A vacuum cleaner as set forth in claim 2 further including a cleaning solution tank, separate from said recovery tank, and a pump associated with said cleaning solution tank for providing a cleaning solution at high pressure to a pressure conduit having a manually operable valve, whereby said solution can be selectively dispensed onto a surface to be cleaned by said vacuum cleaner.

4. A vacuum cleaner as set forth in claim 1 wherein a foraminate filter bag is releasably secured to said one end of said second passage, said bag having foramina sized to easily pass air from said one end of said second passage to said first passage, but to retain particles of dirt removed from said surface during dry vacuum cleaning.

5. A vacuum cleaner as set forth in claim 1 further including a wire frame supported on said one end of said second passage and extending substantially across said open top of said recovery tank, and a cloth filter disposed over said wire frame and interposed between said one end of said second passage and said first passage, whereby air will be permitted to flow from said one end of said second passage, through said cloth filter and wire frame to said first passage, and particles of dirt removed from said surface during dry vacuum cleaning will be retained in said recovery tank.

6. A vacuum cleaner as set forth in claim 1 wherein said recovery tank is a generally cylindrical pail which stands loosely in said support structure and includes a handle to facilitate manual removal from and insertion into said support structure.

* * * * *